US009214715B2

(12) United States Patent
Mei et al.

(10) Patent No.: US 9,214,715 B2
(45) Date of Patent: Dec. 15, 2015

(54) HYBRID COUPLER DEVICE HAVING PLURAL TRANSMISSION LINE STRUCTURES WITH UNWOUND-REWOUND GEOMETRY

(71) Applicant: Anaren, Inc., East Syracuse, NY (US)

(72) Inventors: Chong Mei, Jamesville, NY (US); Halid Mustacoglu, Fayetteville, NY (US)

(73) Assignee: Anaren, Inc., East Syracuse, NY (US)

( * ) Notice: Subject to any disclaimer, the term of this patent is extended or adjusted under 35 U.S.C. 154(b) by 211 days.

(21) Appl. No.: 13/840,137

(22) Filed: Mar. 15, 2013

(65) Prior Publication Data

US 2014/0085019 A1 Mar. 27, 2014

Related U.S. Application Data

(60) Provisional application No. 61/706,363, filed on Sep. 27, 2012.

(51) Int. Cl.
*H01P 5/18* (2006.01)

(52) U.S. Cl.
CPC ..... *H01P 5/184* (2013.01); *H01P 5/187* (2013.01)

(58) Field of Classification Search
CPC ..... H01P 5/12; H01P 5/184; H01P 5/187; H01P 5/16; H01P 5/19
USPC ..... 333/117, 119, 116
See application file for complete search history.

(56) References Cited

U.S. PATENT DOCUMENTS 7,646,261 B2 1/2010 Kirkeby
8,044,749 B1 10/2011 Witas et al.

*Primary Examiner* — Benny Lee
(74) *Attorney, Agent, or Firm* — Daniel P. Malley; George R. McGuire; Bond Schoeneck & King, PLLC

(57) ABSTRACT

The present invention is directed to a hybrid coupler device that includes a first transmission line structure and a second transmission line structure. The first transmission line structure is interdigitally coupled with the second transmission line structure such that each transmission line in the second transmission line structure is disposed adjacent to a transmission line in the first transmission line structure. The coupling or the mutual capacitance $C_d$ between the transmission lines of the present invention need not be equal; in fact, they all can be different.

28 Claims, 10 Drawing Sheets

HYBRID COUPLER DEVICE HAVING PLURAL TRANSMISSION LINE STRUCTURES WITH UNWOUND-REWOUND GEOMETRY

CROSS-REFERENCE TO RELATED APPLICATIONS

This is related to U.S. Provisional Patent Application Ser. No. 61/706,363 filed on Sep. 27, 2012, the content of which is relied upon and incorporated herein by reference in its entirety, and the benefit of priority under 35 U.S.C. §119(e) is hereby claimed.

BACKGROUND OF THE INVENTION

1. Field of the Invention

The present invention relates generally Microwave/RF components and more specifically coupled transmission line components.

2. Technical Background

A directional coupler is a four port passive device that is used to combine, split and/or direct an RF signal within an RF circuit in a desired, predictable manner. A coupler can be implemented by placing two transmission lines in relatively close proximity to each other. Directional couplers operate in accordance with the principles of superposition and constructive/destructive interference of RF waves. When splitting a signal, the RF signal directed into the input port of coupler is split into two RF signals. A first portion of the RF signal is available at the second port and a second portion of the RF signal is available at the third port. A coupler can also be used to combine two input signals to create one output signal. An essential feature of directional couplers is that they only couple the RF power flowing in one direction.

In the splitting case, the amount of RF signal power in the first and second output signals should equal the RF signal power of the input signal. However, the coupler usually has an "insertion loss" which accounts for the differences between the input signal and the output signals. The coupled output signal and the direct output signal are out of phase with respect to each other. At the isolation port, there is destructive interference of RF waves and the RF signals cancel such that there is no appreciable signal available at the fourth port. When a directional coupler is well designed, none of the power incident from the input port is available at the isolated port. In practice, the cancellation is not perfect and a residual signal may be detected. The residual signal at the isolation port is another measure of the performance of the device. Hybrid couplers are commonly used in many wireless technologies to divide a power signal into two signals. In many instances the size of the coupler is critical for both application requirements and material cost benefits.

In many applications it is desirable for the coupler to perform symmetrically so that the functionality and the performance of a symmetrical coupler should not be dependent on which end of the device is used as the input or output. As noted above, when an RF signal is directed into the first port (i.e., the input port) of a symmetrical coupler, one 3 dB signal is available at the second port (DC port) and a second 3 dB signal is available at the third port (coupled port). At the fourth port (isolation port), no appreciable signal is available. In a symmetrical coupler (as is well known in the art), the input signal can be redirected into the second port (DC port) such that the 3 dB signals are available at the first (input) port and the fourth (isolation) port. In this arrangement, the third (coupled) port functions as the isolation port.

The coupling factor is an important property of a directional coupler and is defined as the ratio of the output power of the coupled port over the input power. Hybrid couplers exhibit a coupling factor of −3 dB because they divide the incident RF signal equally between coupled port and DC port. When there is 90 degree phase difference between the coupled port path and DC port path, hybrid couplers are called 90 degree hybrid couplers. 90 degree hybrid couplers are widely employed in RF circuits such as low noise amplifiers, power amplifiers, attenuators, and mixers. However, other coupling factors are also widely used because there is often a need for power sampling functionality. For example, −5 dB, −6 dB, −10 dB, −20 dB and −30 dB are popular coupling factor values.

More formally, coupler structures can typically be described as two transmission lines of length l with an even and odd mode impedance, $Z_{0E}$ and $Z_{0O}$, respectively. The length of the coupler may be put in terms of the dielectric constant ($\in_R$) of the material used to implement the transmission line in accordance with the following formula:

$$l = \frac{c}{4f_0\sqrt{\varepsilon_r}}$$

Where c is the speed of light and $f_0$ is the desired center frequency.

The even mode impedance is the line impedance when the two coupled lines are at the same electric potential. The odd mode impedance is the line impedance when the lines have opposite electric potential. The overall system impedance $Z_0$ of the coupled line pair is given by:

$$Z_0=(Z_{0e}Z_{0o})^{-1/2}$$

The coupling factor, k, is given from the even mode and odd mode impedance parameters:

$$k = \frac{Z_{0e} - Z_{0o}}{Z_{0e} + Z_{0o}}$$

To achieve a tight coupling factor, the even mode impedance must be relatively high and the odd mode impedance should be relatively low, while maintaining the proper system impedance. For example, a 3 dB coupler in a 50 ohm system could have an even mode impedance of approximately 120.7 ohms and an odd mode impedance of approximately 20.7 ohms. If the coupler is designed as a 90 degree coupler, the length of the coupled lines is chosen to be a quarter wavelength (90°) long at the coupler's operating frequency ($f_0$) (i.e., the frequency of the RF signal being divided or combined).

One of the main challenges that RF design engineers are facing is to reduce the overall size of the device while maintaining the part performance. Various approaches have been used to reduce coupler size, but each approach has its respective drawbacks. For example, meandered line structures exhibit an even/odd mode phase velocity imbalance that limits the operational bandwidth. Moreover, the asymmetry of the line layout results in loss of performance symmetry. The inter-digital approach has been considered as a means to achieve high coupling in smaller volume, however, it does not have the desired symmetry.

What is needed is a symmetrical hybrid coupler that addresses the needs described above. In particular, a symmetrical hybrid coupler is needed that achieves high coupling in a smaller volume. A device is further needed that provides improved power handling and lower thermal resistivity in the z-direction.

SUMMARY OF THE INVENTION

The present invention is directed to a symmetrical hybrid coupler that addresses the needs described above. In particular, the symmetrical hybrid coupler of the present invention achieves high coupling and symmetry in a smaller volume. Moreover, the present invention provides improved power handling and lower thermal resistivity in the z-direction.

One aspect of the present invention is directed to a hybrid coupler device that includes a first transmission line structure having a first transmission line disposed in parallel with N third transmission lines, wherein N is an even integer value greater than or equal to two. The first transmission line and the N third transmission lines are interconnected between a first port and a second port. The first transmission line and the N third transmission lines are characterized by a predetermined planar arrangement that includes a plurality of geometric patterns. The predetermined planar arrangement is configured such that a current propagating in one geometric pattern of the plurality of geometric patterns does not oppose a current propagating in another geometric pattern of the plurality of geometric patterns. A second transmission line structure includes a second transmission line disposed in parallel with N fourth transmission lines. The second transmission line and the N fourth transmission lines are interconnected between a third port and a fourth port. The second transmission line and the N fourth transmission lines are characterized by the predetermined planar arrangement including the plurality of interconnected planar geometric patterns. The first transmission line structure is interdigitally coupled with the second transmission line structure such that each transmission line in the second transmission line structure is disposed adjacent to a transmission line in the first transmission line structure.

In one embodiment, the transmission line in the second transmission line structure is disposed on a first side of a first dielectric portion and the adjacent transmission line in the first transmission line structure is disposed on a second side of the dielectric portion to form a first coupler layer. In one version of the embodiment, the first coupler layer is disposed between a second dielectric portion and a third dielectric portion, the first dielectric portion is characterized by a first dielectric constant, and wherein the second dielectric portion and the third dielectric portion are characterized by a second dielectric constant different than the first dielectric constant.

In one embodiment, the coupler is a stripline device. In another embodiment, The transmission line in the second transmission line structure disposed adjacent to the transmission line in the first transmission line structure are broadside coupled transmission lines. In another embodiment, the first transmission line structure and the second transmission line structure are vertically aligned. In another embodiment, the geometric patterns in the predetermined planar arrangement are arranged in a symmetrical arrangement.

In yet another embodiment, the geometric pattern includes a transmission line winding. In one version of the embodiment, a linewidth of a transmission line in the transmission line winding is less than or equal to 130 μm. In another version of the embodiment, a linewidth of a transmission line in the transmission line winding is substantially in a range between 90 μm and 110 μm. In another version of the embodiment, a line length of a transmission line in the transmission line winding is less than 20 mm.

In yet another embodiment, the geometric pattern includes a spiral transmission line configuration.

In yet another embodiment, the geometric pattern includes an unwound-rewound transmission line geometry. In one version of the embodiment, a linewidth of a transmission line in the transmission line winding is less than or equal to 130 μm. In another version of the embodiment, a linewidth of a transmission line in the transmission line winding is substantially in a range between 90 μm and 110 μm. In another version of the embodiment, a line length of a transmission line in the transmission line winding is less than 20 mm.

In yet another embodiment, the phase balance of the device is substantially more than 50% relative bandwidth. In yet another embodiment, the coupling between adjacent transmission lines is not equal. In yet another embodiment, the excitation of the first port, the second port, the third port and the fourth port are substantially symmetrical.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention, and together with the description serve to explain the principles and operation of the invention.

DETAILED DESCRIPTION OF THE PRESENT INVENTION

Reference will now be made in detail to the present exemplary embodiments of the invention, examples of which are illustrated in the accompanying drawings. Wherever possible, the same reference numbers will be used throughout the drawings to refer to the same or like parts and may not be described in each drawing figure in which they appear. An exemplary embodiment of the coupler 10 of the present invention is shown in FIG. 1.

Figure 1:
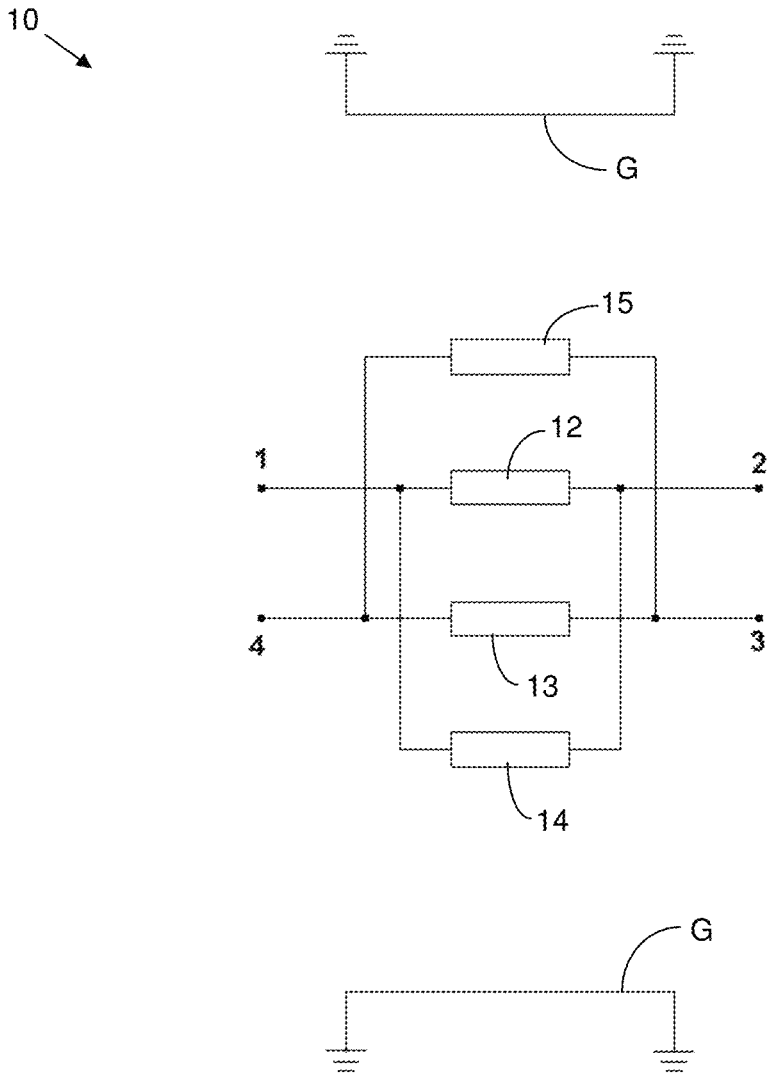
FIG. 1 is a schematic diagram of the coupler in accordance with a first embodiment of the present invention.

As embodied herein and depicted FIG. 1 is a schematic diagram of the coupler in accordance with a first embodiment of the present invention is disclosed. In this embodiment of the present invention, the coupler includes four transmission lines that are interdigitally connected to each other. The transmission line 12 is interconnected between port 1 and port 2. Transmission line 14 is coupled in parallel with transmission line 12. The transmission line 13 is interconnected between port 3 and port 4. Transmission line 15 is coupled in parallel with transmission line 13. The above described coupler structure is disposed between upper and lower ground planes G. According to the teachings of the present invention, the number of broadside coupled and interdigitally connected transmission lines can be increased to counter-intuitively reduce the size and thickness of the device while maintaining or increasing the power handling capability of the device.

Figure 2A:
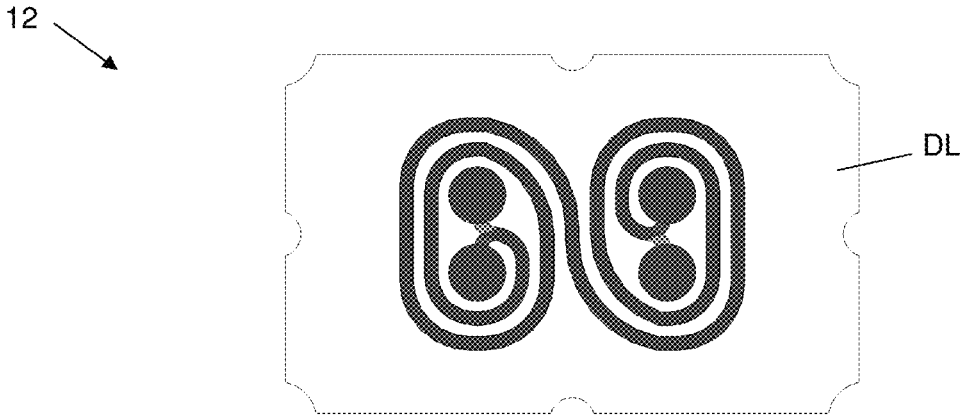
FIGS. 2A-2C are plan views of the various layers of the coupler in accordance with one embodiment of the present invention.
Figure 2B:
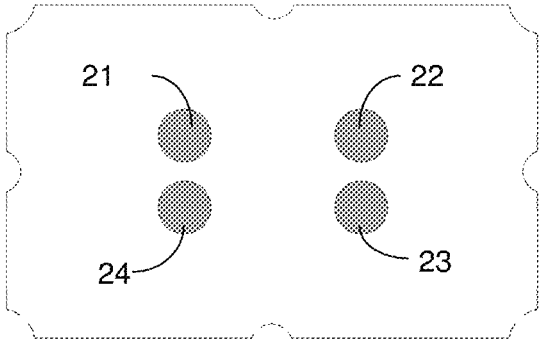
Figure 2C:
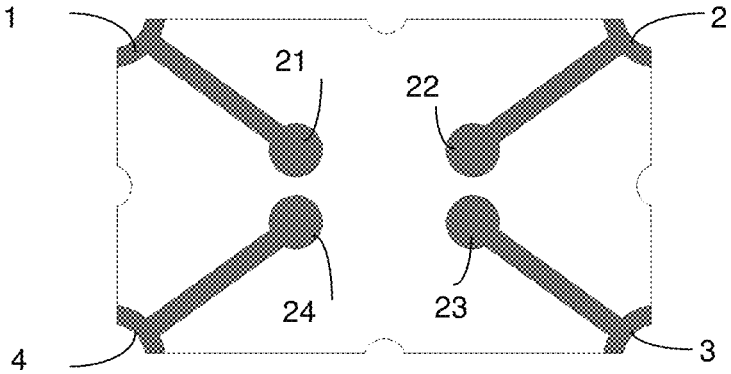

Referring to FIGS. 2A-2C, plan views of the various layers of the coupler in accordance with one embodiment of the present invention is disclosed. FIG. 2A shows an example of the broadside coupled traces 12 disposed on a dielectric layer DL. In this example, the line width is approximately within a range between 114-124 μm. The line spacing is approximately within a range between 91-101 μm. The line length is approximately 19.6 mm. Depending on the dielectric materials used, the line widths, spacing between lines, and the line lengths may be different than these values.

The pattern depicted in FIG. 2A is referred to herein as an "unwound/rewound" pattern, and refers to the two interconnected spiral shaped "windings" that form one transmission line disposed on the dielectric surface DL. As described below, the wound portion on the right is connected to one port, and the wound portion on the left is connected to another port; both by way of vertical transmission line vias. As described herein, there are additional transmission lines disposed in parallel and underneath the transmission line 12. Each transmission line is connected to between two ports by vertical vias that service other transmission lines. FIG. 2B shows the four interconnection vias 21, 22, 23, and 24; and FIG. 2C shows how these vias 21, 22, 23, and 24 are connected to their respective ports 1, 2, 3, and 4.

Figure 3A:
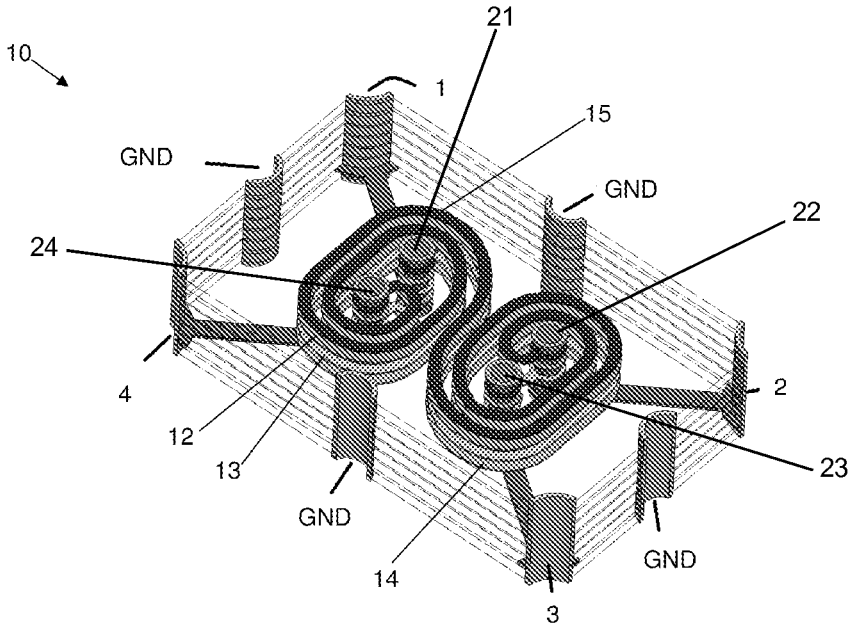
FIGS. 3A-3F show various perspective views of a coupler in accordance with an embodiment of the present invention.

Referring to FIGS. 3A-3F, various perspective views of a coupler in accordance with an embodiment of the present invention are disclosed. In FIGS. 3A-3F, as before, reference numbers 1, 2, 3 and 4 denote port 1, port 2, port 3 and port 4, respectively. FIG. 3A clearly illustrates a perspective view of the unwound/rewound spiral coupler 10. The dielectric layers DL (shown in FIG. 2A) are removed for sake of clarity. Four ground interconnections (GND) are provided at each side of the device by ground vias (as shown in FIGS. 3A-3F). Transmission line 15 is shown extending from port 2 to port 4. Transmission lines 12, 13 and 14 are disposed directly underneath in that order. Their interconnections are shown in the following Figures. When a current propagates in the left-half of the transmission line 15, for example, a magnetic field (H) is generated. Because of the way the left-half of the transmission line is connected to right-half of the transmission line, the magnetic field (H) forms a "ring" that intersects the coupler center portion.

Figure 3B:
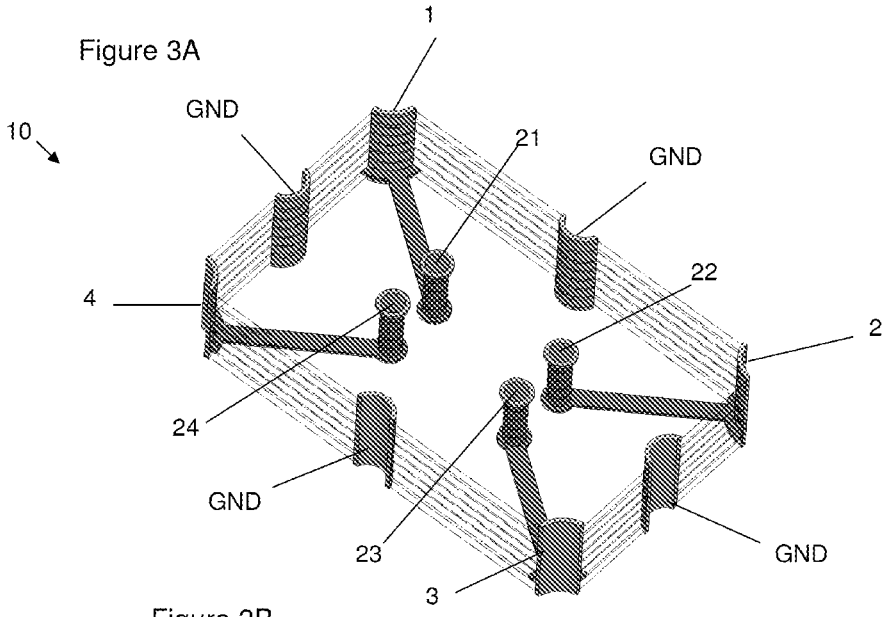
Figure 3C:
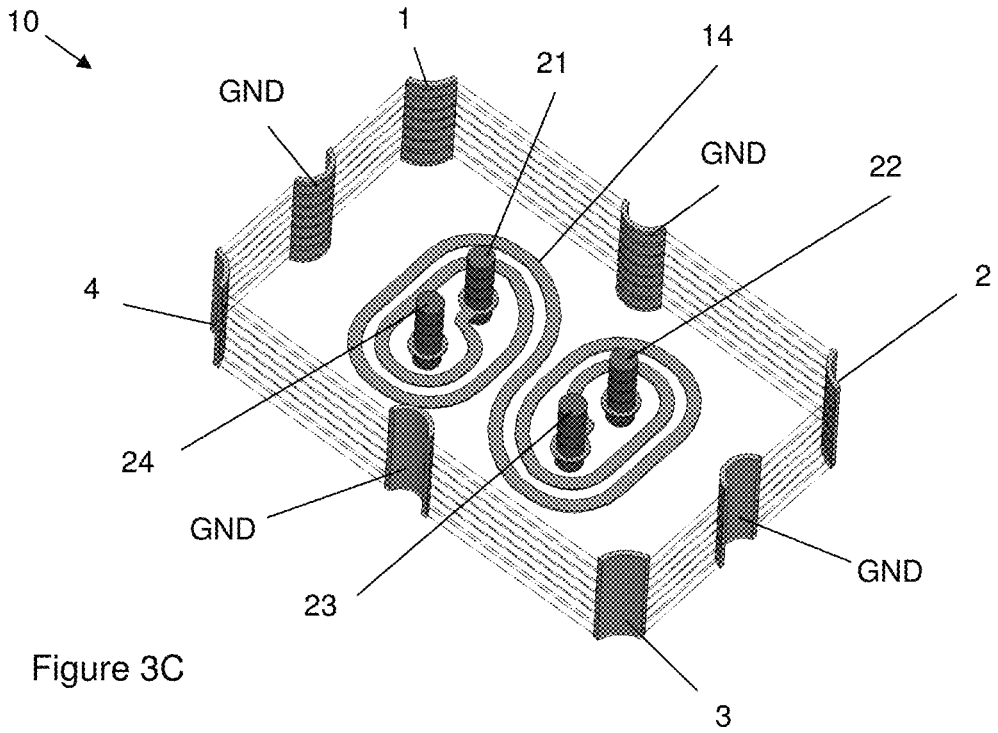
Figure 3D:
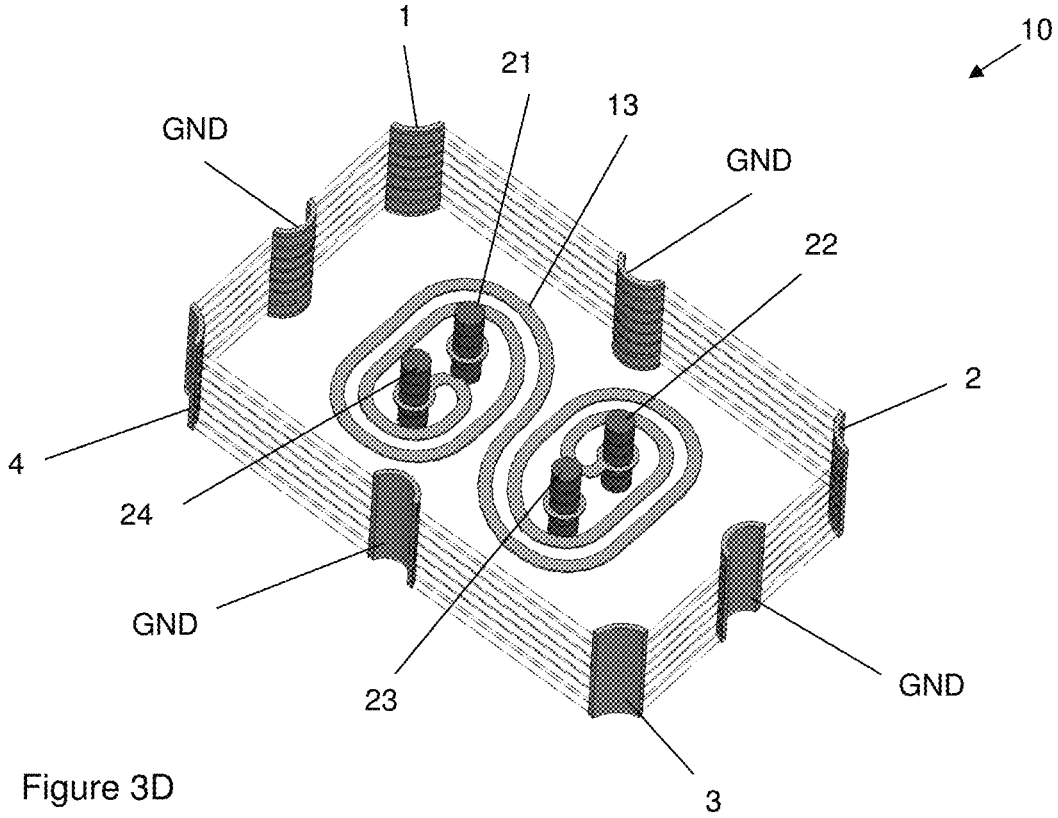
Figure 3E:
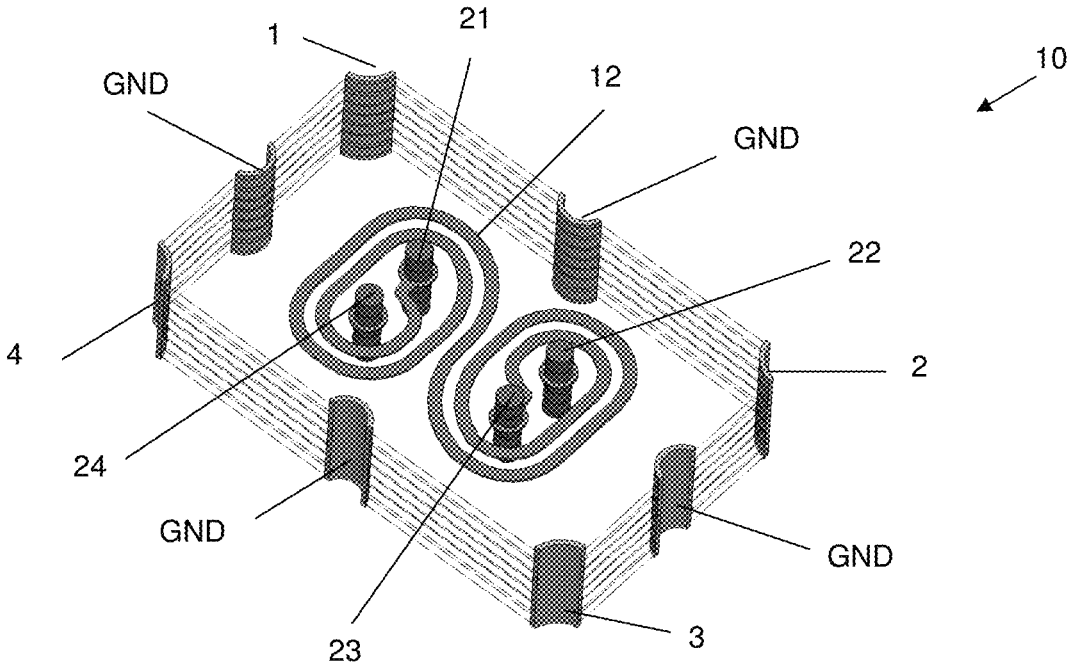
Figure 3F:
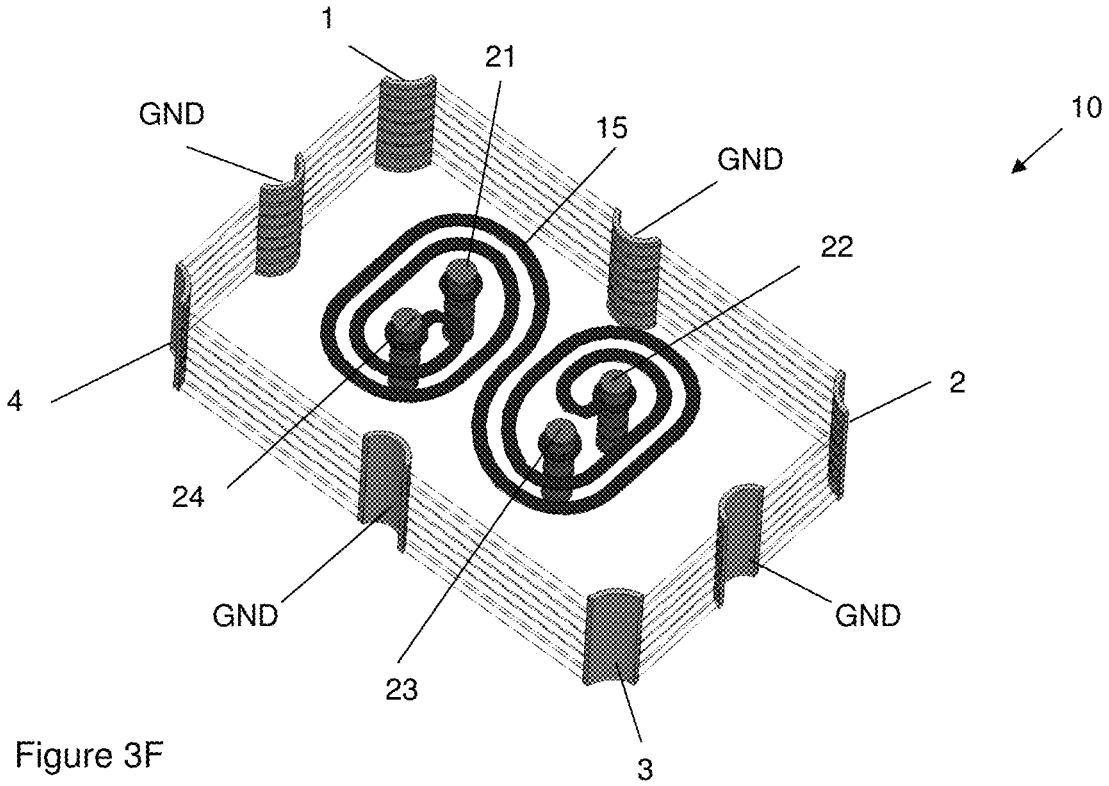

FIG. 3B shows the vias 21, 22, 23, and 24 connected to their respective ports 1, 2, 3, and 4. As alluded to above, the vias interconnect respective transmission lines in accordance with the schematic diagrams of FIGS. 1 and 6. FIG. 3C shows the lowest transmission line 14 connected between vias 21 and 23, and hence coupled to ports 1 and 3. FIG. 3D shows the next transmission line 13 connected between vias 23 and 22, and hence coupled to ports 2 and 4, as expected. FIG. 3E shows the next transmission line 12 connected between vias 21 and 23, and hence coupled to transmission line 14 and ports 1 and 3. FIG. 3F shows the top transmission line 15 connected between vias 22 and 24, and hence coupled to transmission line 13 and ports 2 and 4.

Thus, the present invention is directed to a coupler that includes four ports and four broadside coupled transmission lines. All four transmission lines are disposed in the same fashion and are vertically aligned to each other. One obvious benefit of this arrangement is its symmetry, and by having a symmetrical layout, symmetrical performance of the coupler can be guaranteed.

When compared to a conventional unwound/rewound transmission line coupler having the same line widths and dielectric materials, the coupler of the present invention and the conventional device will have the same even mode impedance; however, the odd mode impedance of the present invention is smaller than the odd mode impedance of the conventional coupler. Hence, the present invention achieves higher coupling values with the same line width. The line widths of the transmission lines of the present invention can therefore be half of the size of the line widths of conventional devices with the same coupling value. Thus, the present invention provides at least a 50 percent size reduction vis á vis the convention coupler. Although the lines are narrower, the insertion loss of the device is similar to conventional devices that have wider line widths. Note that the insertion loss is inversely proportional to the surface area of the traces. Even though the lines are thinner, the total surface area that carries RF currents in the present invention is larger the conventional device because of the unwound/rewound geometry is disposed on four transmission lines. Thus, the coupler of the present invention exhibits a lower insertion loss in a device that is half the size (of a conventional device that employs a two metal layer approach). In comparison to the present invention, the conventional approaches commonly used to scale down the device size (e.g., using thinner or higher dielectric constant materials) always suffer higher insertion losses and lower power handling capabilities.

The benefit of the unwound/rewound configuration, other than its symmetry, is the improvement of device power handling capability. The even mode currents running along the spiral lines create a magnetic field pattern that results in a higher even mode impedance when compared with devices that employ conventional layouts, i.e., featuring straight lines or meandered lines in same material set. To achieve the required even mode impedance, the thickness of the spacing between the trace layers and the ground layer is reduced. Also it is desirable that spirals in the planar geometry do not oppose each other, i.e., both spirals are either left-handed or both are right-handed such that the magnetic field patterns that are generated enhance each other. This feature further reduces the required ground spacing. The thinner ground spacing allows the heat that is generated by the traces to travel a shorter path to the ground layer (where the heat sink is typically located). Since the overall thermal resistivity in the z-direction—relative to the x-y plane that accommodates the transmission line layers (12, 13, 14 and 15)—is much lower with four layers of coupled lines, the power handling is improved over conventional devices.

Another benefit of the unwound/rewound broadside coupler configuration described herein relates to the maximized line width density (for a given package size). For example, the transmission lines may be placed tightly to increase line density because the currents in adjacent lines do not oppose each other. This is not true in, e.g., meandered line configurations. With the compact spiral layout, the lines are disposed much closer together edge-wise. The thermal conductivity in the x-y plane is also much higher due to the high copper percentage in circuit area. The x-y plane refers to the length dimension "x" and the width dimension "y" shown in FIG. 5A. The "z" dimension is shown in FIG. 5B). Hence, thermal energy from a hotspot or local trace defect is conducted to adjacent traces, and subsequently, in the z-direction and out to the ground plane and the device exterior, so that the power handling capacity is much improved over conventional devices.

Figure 4A:
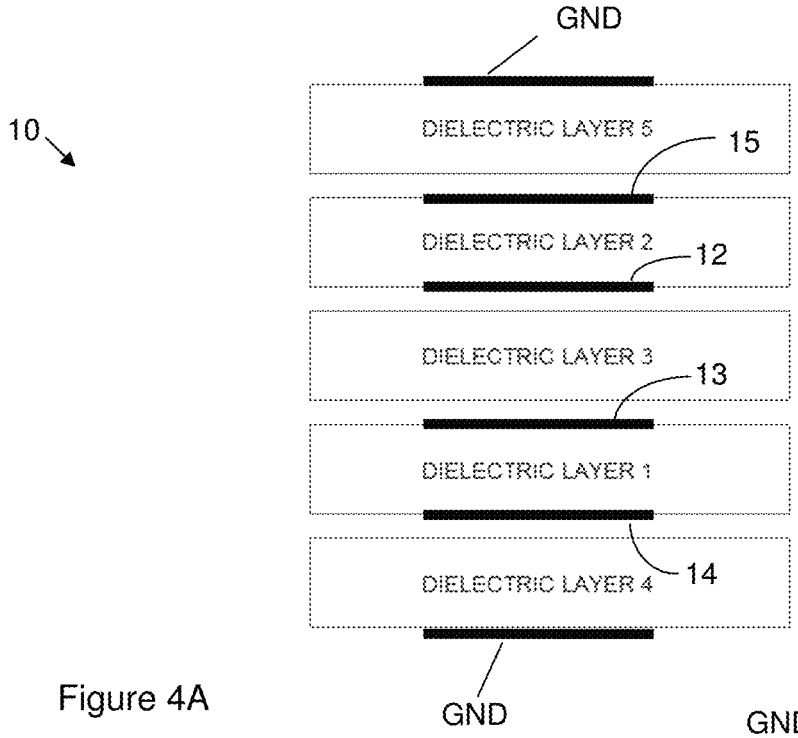
FIGS. 4A-4B are cross-sectional diagrammatic views illustrating the various layers of the coupler depicted in FIGS. 3A-3F.
Figure 4B:
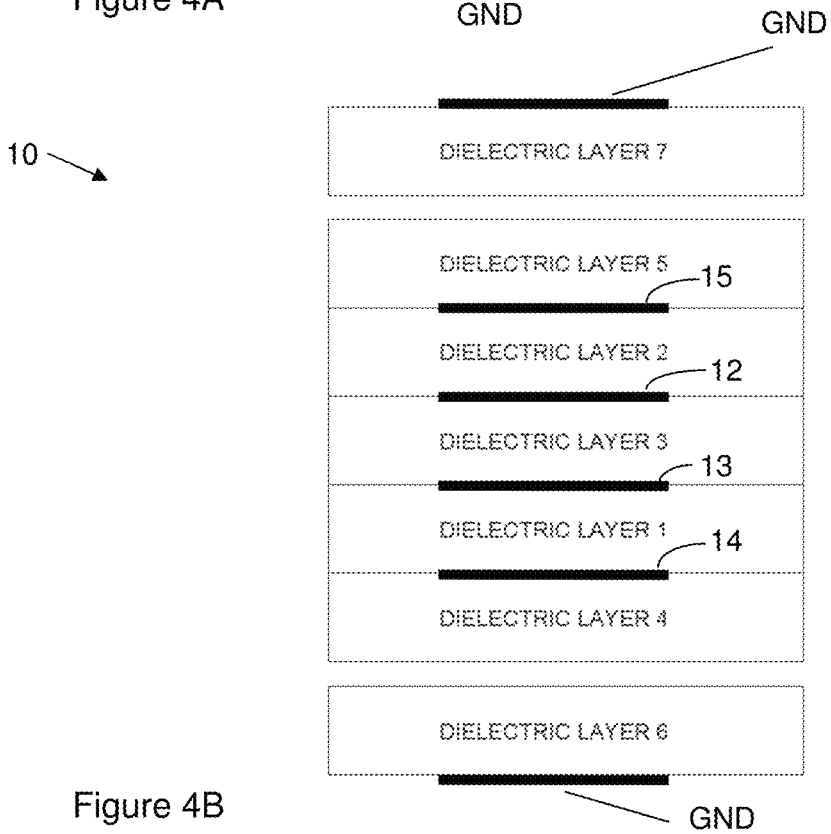

Referring to FIGS. 4A-4B, cross-sectional diagrammatic views illustrating the various layers of the coupler 10 are disclosed. In FIGS. 4A-4B, as before, reference "GND" refers to ground. FIG. 4A illustrates the cross-sectional view of the initial process layers used for manufacturing the coupler 10. In one embodiment, the unwound/rewound transmission lines are disposed on each side of the PYRALUX® dielectric layers (1, 2). Bonding films are used to bond the PYRALUX® (i.e., polyimide or polyimide composite) dielectric layers to PTFE (i.e., Polytetrafluoroethylene) composite boards, which are disposed on either side of PYRALUX® (i.e., polyimide or polyimide composite) dielectric layers. The dielectric constant of layers 4 and 5 are equal to 6.15 and layer 3 is equal to 3.5. The dielectric constants of bonding layers are equal to 2.0. These boards are implemented using commercially available ROGERS RO-3035, RO-3006 (ceramic filled PTFE) boards, and the bonding films are implemented using commercially available DUPONT PFA (Perfluoroalkoxy) and FEP (fluorinated ethylene propylene) fluoropolymer films.

FIG. 4B illustrates a subsequent process step in the manufacturing of the coupler device. In this view, the bonded dielectric layers (1-5) are disposed between the two outer dielectric layers of PTFE (Polytetrafluoroethylene) composite layers (6, 7) and these are bonded as well. The dielectric constant of layers 6 and 7 are equal to 6.15. The boards may be implemented using commercially available ROGERS RO-3035, RO-3006 (ceramic filled PTFE) boards, and the bonding films are implemented using commercially available DUPONT PFA (Perfluoroalkoxy) and FEP fluorinated ethylene propylene) films. Each board comes with a 0.5 ounce copper layer on both sides of the dielectric board. (Those of ordinary skill in the art will appreciate that the copper layers that are not used or needed in the design depicted in FIG. 4B are easily removed). The seven layers with six bonding films are bonded together to get the stripline structure. The copper layers on the outer surfaces of dielectric layer 6 and dielectric layer 7 form the ground planes. Multiple ground planes within the package may be disposed depending on the need.

Modifications and variations can be made to dielectric layers of the present invention depending on their properties. For example, dielectric layers between the coupled spiral transmission lines may be realized using a polyimide dielectric material, which in here is implemented by using a commercially available material commonly referred to as PYRALUX®.

The present invention has some interesting implications. In conventional interdigital couplers, the coupling (i.e., the mutual capacitance $C_d$) between the adjacent transmission lines must be equal. The coupling or the mutual capacitance $C_d$ between the transmission lines of the present invention need not be equal; in fact, they can all be different. Even with the symmetry requirement, the example depicted in FIG. 1 can have one mutual capacitance $C_{d1}$ between transmission line 15 and transmission line 12 and another value $C_{d2}$ between transmission line 12 and transmission line 13. Device symmetry is satisfied as long as the value of mutual capacitance $C_{d1}$ between transmission line 12 and 15 is the same as the mutual capacitance $C_{d3}$ between transmission line 13 and 14. The same impedance and coupling value can be achieved as long as the average of $C_{d1}$, $C_{d2}$ and $C_{d3}$ equal to the $C_d$.

This additional design freedom provides flexibility from a layout efficiency point of view; while the parallel transmission lines typically have the same exact line width, they need not be the same. In fact, the various line widths can be adjusted to slightly different values in order to fine tune the coupling value. The design freedom also provides process flexibility in that the layer spacing and dielectric constants employed between transmission lines can be different. As shown in the example embodiment of current invention, the dialectic layer 1 and 2 are implemented using a rigid core material to guarantee a consistent manufacturing process, while at the same time, the dialectic layer 3 between transmission line 12 and 13 is implemented using a bonding layer that is characterized by a different dielectric constant and thickness.

Figure 5A:
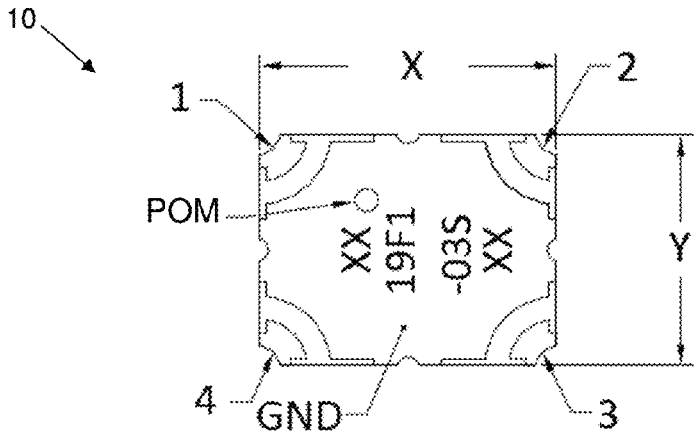
FIGS. 5A-5C are various views of a surface mount coupler device in accordance with the present invention.
Figure 5B:
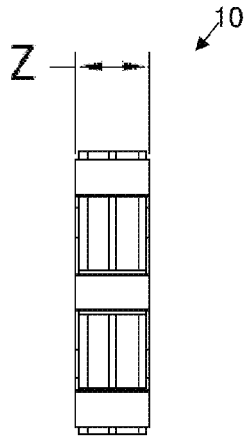
Figure 5C:
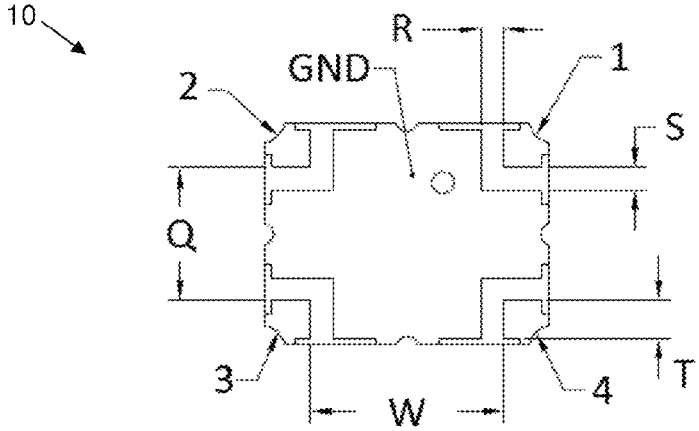

Referring to FIGS. 5A-5C, various views of a surface mount coupler device in accordance with the present invention are disclosed. In FIGS. 5A, 5C, and as before, reference "GND" refers to ground. The X dimension is approximately 0.200 inches, and the Y dimension is approximately 0.125 inches as shown in FIG. 5A. As shown in FIG. 5C, the distance ("Q") between the pins along the short side of the device is approximately equal to 65 mils in this embodiment. The distance ("W") between the pins along the long side of the device is approximately equal to 140 mils in this embodiment. The pin dimension ("T") is approximately 25 mils and the border area between each pin and the ground surface has a thickness ("R") of about 15 mils in this example embodiment. As shown herein, the dimension "S" is similar to dimension R. As shown in FIG. 5B, the thickness (Z-dimension) of the device is approximately 47 mils in this embodiment.

The coupler 10 is disposed in a shielded standard package. The four ports (1-4) are disposed at respective corners of the device and are typically implemented using mounting pads. The ground reference (GND) of the device is provided in the center portion of the device as shown at FIGS. 5A and 5C. The environmental interference has minimum impact on the performance of the coupler. In the unwounded/rewounded layout arrangement, the interconnection vias (21-24) are typically disposed inside the spirals (as shown, e.g., at FIG. 3A). To separate the vias and provide a conductive path to their respective ports located in the corners of the device, the fourth and fifth dielectric layer are laminated to the exterior of the first layer and the second layer, respectively. Then, four traces can be formed on the bottom of the fourth dielectric layer to conduct the inner vias to four corners of the devices. Finally, the sixth and seventh dielectric layers are laminated on the bottom and top of the above mentioned five layers. See, e.g., FIGS. 4A-4B, for the cross-sectional view of the various layers. The mounting pads are placed on the bottom of the sixth layer. The ground shielding is placed on the top of the seventh layer. The corner vias interconnect the inner traces and the bottom pads. The side vias interconnect the top ground shielding and the bottom ground pads. The desired even mode impedance of the coupler is be achieved by adjusting the thickness and dielectric constant of the fourth, fifth, sixth and seventh dielectric layers. An additional ground plane can be disposed between the fourth layer and the fifth layer to fine tune the even mode impedance. See, e.g., FIGS. 4A-4B, for the cross-sectional view of the various layers.

Figure 6:
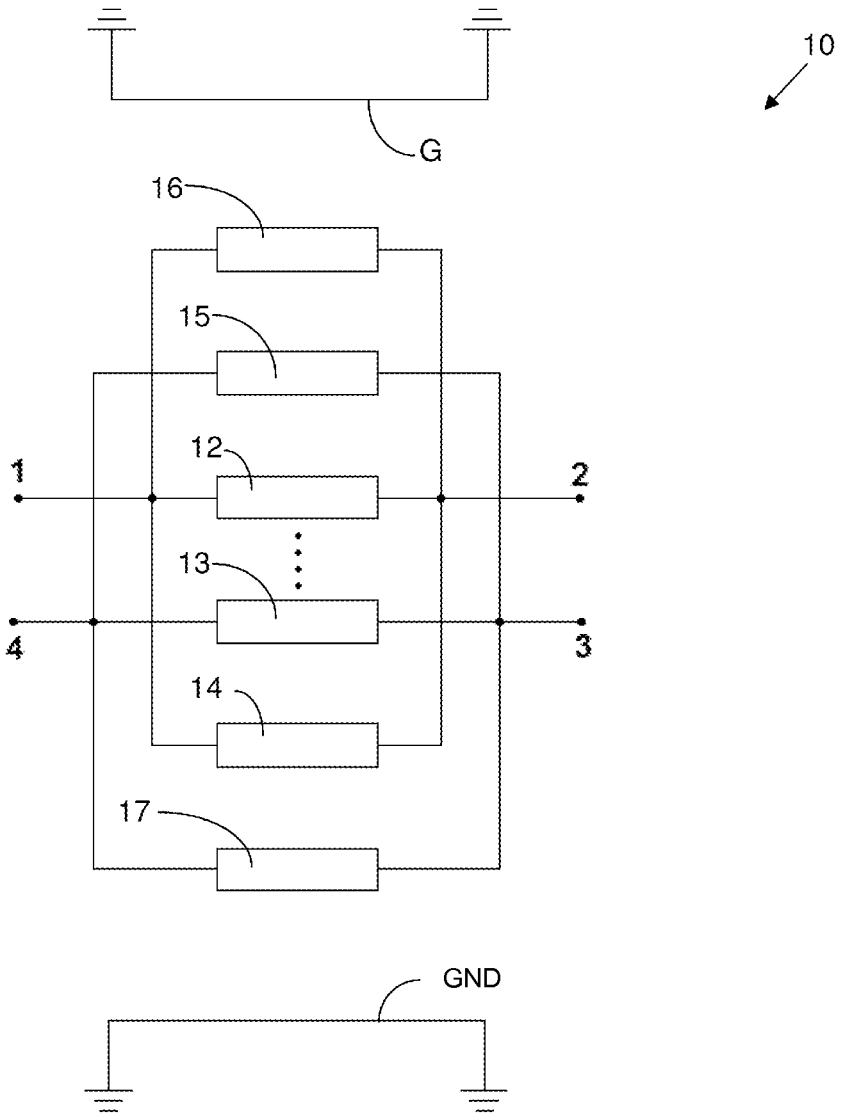
FIG. 6 is a schematic diagram of the coupler in accordance with another embodiment of the present invention.

As embodied herein and depicted in FIG. 6, a schematic diagram of the coupler in accordance with another embodiment of the present invention is disclosed. In this embodiment, the coupler includes more interdigitally connected lines (e.g. transmission lines 16 and 17) wherein N is equal to the number of lines interdigitally connected. By increasing the number of transmission lines that are interdigitally connected, the size and thickness of the device may be reduced while the power handling capability of the device is maintained or improved. The number of broadside coupled and interdigitally connected transmission lines can be increased depending on the design requirements.

Figure 7:
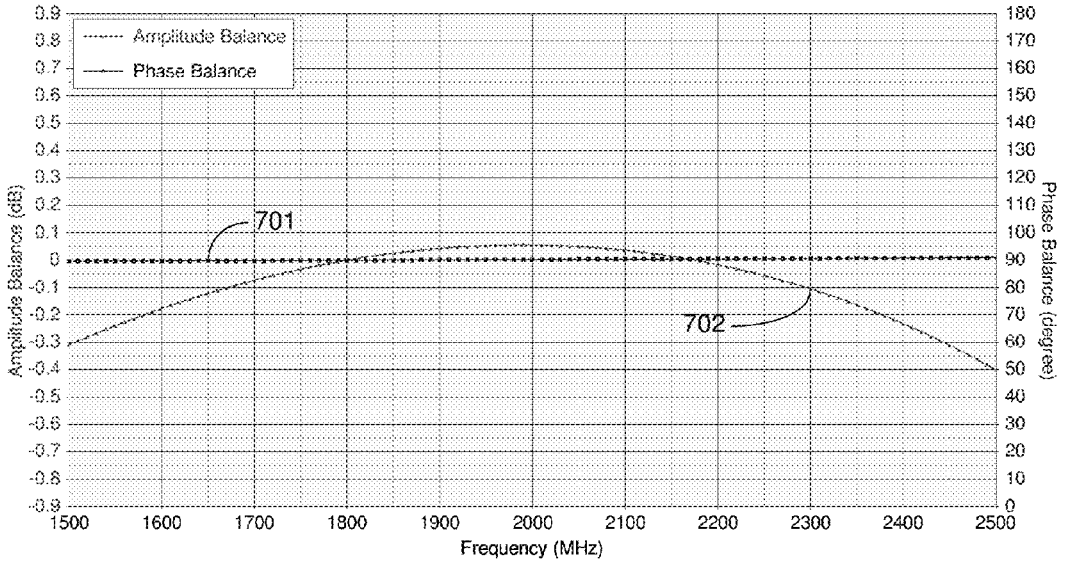
FIG. 7 is a chart illustrating the amplitude balance and phase balance performance plot of the unwound/rewound spiral coupler of the present invention.

FIG. 7 is a chart illustrating the amplitude balance (in dB) and phase balance (in degrees) performance plot, respectively, vs. frequency (MHz), of the unwound/rewound spiral coupler of the present invention. The phase balance 701 is substantially constant across the entire spectrum. The amplitude balance 702 varies from about +0.1 dB at center frequency to about −0.3 dB at about 500 MHz from the center frequency.

Figure 8:
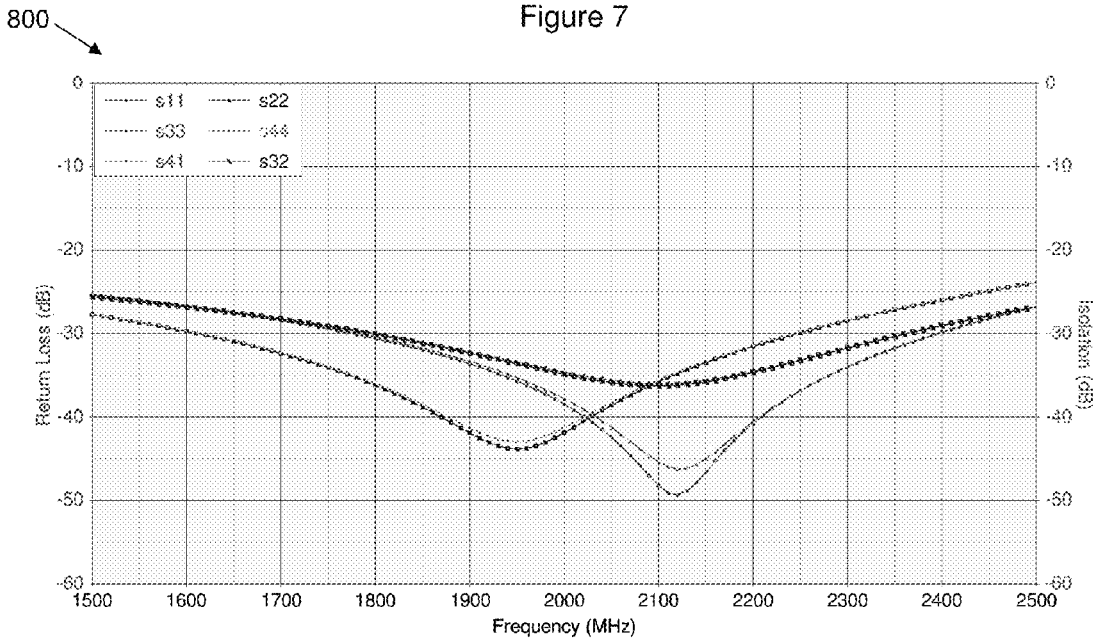
FIG. 8 is a chart illustrating the return loss and isolation performance plot of the unwound/rewound spiral coupler of the present invention.

FIG. 8 is a chart illustrating the return loss (in dB) and isolation (in dB) vs. frequency (in MHz), performance plot of the unwound/rewound spiral coupler of the present invention. As shown in FIG. 8, certain S-parameters are plotted. As those of ordinary skill in the art will appreciate, S-parameters are often used to characterize the return and isolation losses for RF networks; and because the S-parameters change with the measurement frequency, the frequency is specified for the S-parameter measurements presented in FIG. 8. As those of ordinary skill in the art will also understand, the S-parameters are typically employed to specify the incident and reflected waves at the ports of a multi-port network. The S-parameters are employed in an S-parameter matrix that is used in conjunction with an incident power wave matrix and a reflected power wave matrix in accordance with standard network theory and conventional matrix mathematical principles. The subscripts (e.g., s11) refer to the position of the S-parameter in the matrix and the definitions of each S-parameter are known to those of ordinary skill in the art.

Figure 9:
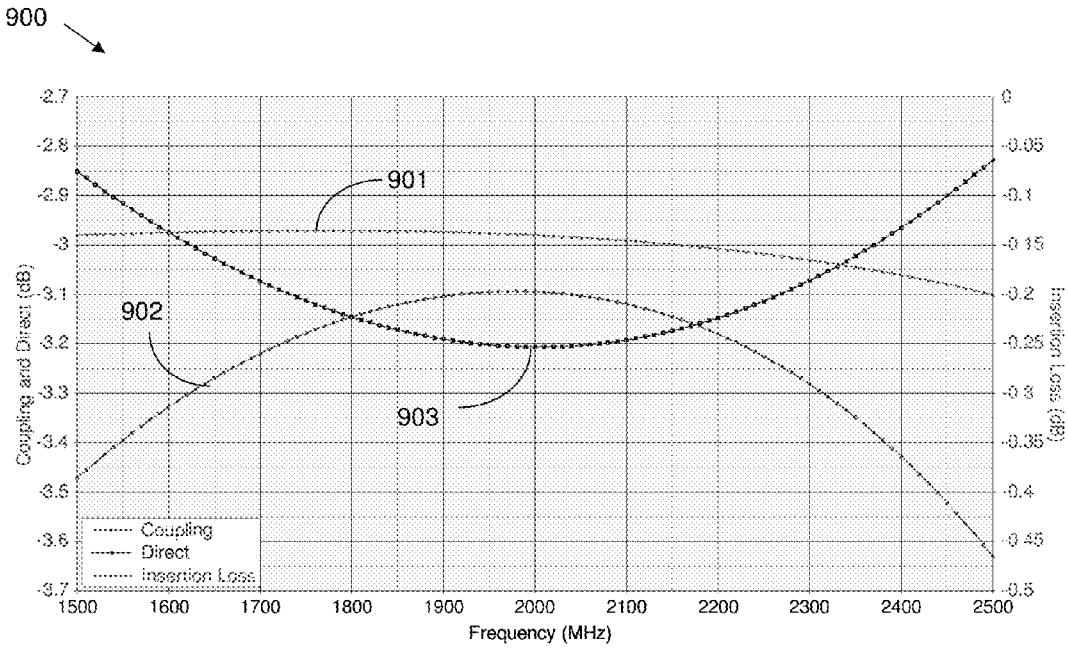
FIG. 9 illustrates the coupling, direct, and insertion loss performance plot of the unwound/rewound spiral coupler of the present invention.

FIG. 9 illustrates the coupling, direct, and insertion loss performance plot of the unwound/rewound spiral coupler of the present invention. Plot line 901 shows the insertion loss (dB) as a function of frequency (MHz). Plot line 902 shows the coupling loss (dB) as a function of frequency (MHz). As those of ordinary skill in the art will appreciate, the coupling loss refers to the amount of power lost to the coupled port. Plot line 902 shows the directivity (dB) as a function of frequency (MHz). Again, as those of ordinary skill in the art will appreciate, directivity is a measure of how independent the coupled and isolated ports are; since it is impossible to build a perfect coupler, there will always be some amount of unintended coupling between all the signal paths.

FIG. 7-9 shows a coupler performance of this present invention achieving over 50% relative bandwidth. These performances are as good as or better than those results of a conventional coupler of similar material set with twice of its size.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening.

The recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed.

No language in the specification should be construed as indicating any non-claimed element as essential to the practice of the invention.

It will be apparent to those skilled in the art that various modifications and variations can be made to the present invention without departing from the spirit and scope of the invention. There is no intention to limit the invention to the specific form or forms disclosed, but on the contrary, the intention is to cover all modifications, alternative constructions, and equivalents falling within the spirit and scope of the invention, as defined in the appended claims. Thus, it is intended that the present invention cover the modifications and variations of this invention provided they come within the scope of the appended claims and their equivalents.

What is claimed is:

1. A hybrid coupler device comprising:

a first transmission line structure including a first transmission line disposed in parallel with N third transmission lines, wherein N is an integer value greater than or equal to one, the first transmission line and the N third transmission lines being interconnected between a first port and a second port, the first transmission line and the N third transmission lines being characterized by an unwound-rewound transmission line geometry; and a second transmission line structure including a second transmission line disposed in parallel with N fourth transmission lines, the second transmission line and the N fourth transmission lines being interconnected between a third port and a fourth port, the second transmission line and the N fourth transmission lines being characterized by the unwound-rewound transmission line geometry, the first transmission line structure being interdigitally coupled with the second transmission line structure in accordance with a predetermined coupling value, each transmission line in the second transmission line structure being disposed adjacent to a corresponding transmission line in the first transmission line structure, each transmission line in the second transmission line structure being coupled to a corresponding adjacent transmission line in the first transmission line structure by a mutual capacitance value of a plurality of mutual capacitance values, the predetermined coupling value being based on an average of the plurality of mutual capacitance values.

2. The device of claim 1, wherein the first transmission line is disposed on a first side of a first dielectric portion and the second transmission line is disposed on a second side of the first dielectric portion to form a first coupler layer.

3. The device of claim 2, wherein the first coupler layer is disposed between a second dielectric portion and a third dielectric portion, the first dielectric portion is characterized by a first dielectric constant, and wherein the second dielectric portion and the third dielectric portion are characterized by a second dielectric constant different than the first dielectric constant.

4. The device of claim 1, wherein the coupler is a stripline device.

5. The device of claim 1, wherein the first transmission line structure and the second transmission line structure are comprised of broadside coupled transmission lines.

6. The device of claim 1, wherein the first transmission line structure and the second transmission line structure are vertically aligned.

7. The device of claim 1, wherein the unwound-rewound transmission line geometry is arranged in a symmetrical arrangement.

8. The device of claim 1, wherein a second current propagating in any transmission line of the second transmission line structure does not oppose a first current propagating in the corresponding adjacent transmission line in the first transmission line structure.

9. The device of claim 1, wherein a linewidth of at least one transmission line in the first transmission line structure or the second transmission line structure is less than or equal to 130 μm.

10. The device of claim 9, wherein the linewidth of the at least one transmission line is substantially in a range between 90 μm and 110 μm.

11. The device of claim 9, wherein a line length of the at least one transmission line is less than 20 mm.

12. The device of claim 1, wherein a phase balance of the device is substantially more than 50% relative bandwidth.

13. The device of claim 1, wherein the unwound-rewound transmission line geometry is characterized by a spiral transmission line configuration.

14. The device of claim 13, wherein a linewidth of at least one transmission line in the spiral transmission line configuration is less than or equal to 130 μm.

15. The device of claim 14, wherein the linewidth of the at least one transmission line is substantially in a range between 90 μm and 110 μm.

16. The device of claim 14, wherein a line length of the at least one transmission line is less than 20 mm.

17. The device of claim 1, wherein the first transmission line is disposed adjacent to the second transmission line.

18. The device of claim 17, wherein the mutual capacitance value of the plurality of mutual capacitance values between the first transmission line and the second transmission line is equal to a first mutual capacitance value, and wherein the mutual capacitance value of a plurality of mutual capacitance values between the first transmission line and one of the N fourth transmission lines is equal to a second mutual capacitance value.

19. The device of claim 18, wherein the hybrid coupler is symmetrical.

20. The device of claim 18, wherein the mutual capacitance value of the plurality of mutual capacitance values between the second transmission line and one of the N third transmission lines is equal to the second mutual capacitance value.

21. The device of claim 1, wherein at least one transmission line in the second transmission line structure is characterized by a line width that is different from a line width of the corresponding adjacent transmission line in the first transmission line structure.

22. The device of claim 21, wherein the first transmission line is disposed adjacent to the second transmission line.

23. The device of claim 22, wherein the mutual capacitance value of the plurality of mutual capacitance values between the first transmission line and the second transmission line is equal to a first mutual capacitance value, and wherein the mutual capacitance value of a plurality of mutual capacitance values between the first transmission line and one of the N fourth transmission lines is equal to a second mutual capacitance value.

24. The device of claim 23, wherein the mutual capacitance value of the plurality of mutual capacitance values between the second transmission line and one of the N third transmission lines is equal to the second mutual capacitance value.

25. The device of claim 21, wherein the hybrid coupler is symmetrical.

26. The device of claim 21, wherein each transmission line in the second transmission line structure is coupled to a corresponding adjacent transmission line in the first transmission line structure by a mutual capacitance value of a plurality of mutual capacitance values, the predetermined coupling value being based on an average of the plurality of mutual capacitance values.

27. The device of claim 21, wherein a second current propagating in a transmission line of the second transmission line structure does not oppose a first current propagating in its corresponding adjacent transmission line in the first transmission line structure.

28. A hybrid coupler device comprising:

a first transmission line structure including a first transmission line disposed in parallel with N third transmission lines, wherein N is an integer value greater than or equal to one, the first transmission line and the N third transmission lines being interconnected between a first port and a second port, the first transmission line and the N third transmission lines being characterized by an unwound-rewound transmission line geometry; and a second transmission line structure including a second transmission line disposed in parallel with N fourth transmission lines, the second transmission line and the N fourth transmission lines being interconnected between a third port and a fourth port, the second transmission line and the N fourth transmission lines being characterized by the unwound-rewound transmission line geometry, the first transmission line structure being interdigitally coupled with the second transmission line structure in accordance with a predetermined coupling value, each transmission line in the second transmission line structure being disposed adjacent to a corresponding transmission line in the first transmission line structure, at least one transmission line in the second transmission line structure having a line width that is different from a line width of the corresponding adjacent transmission line in the first transmission line structure.

* * * * *